US005951207A

United States Patent [19]

Chen

[11] Patent Number: 5,951,207

[45] Date of Patent: Sep. 14, 1999

[54] INSTALLATION OF A FOUNDATION PILE IN A SUBSURFACE SOIL

[75] Inventor: Jen-Hwa Chen, Fullerton, Calif.

[73] Assignee: Chevron U.S.A. Inc., San Francisco, Calif.

[21] Appl. No.: 08/827,325

[22] Filed: Mar. 26, 1997

[51] Int. Cl.[6] ..... E02D 7/28

[52] U.S. Cl. ..... 405/232; 405/228; 405/249

[58] Field of Search ..... 405/224, 224.1, 405/226, 228, 232, 249; 114/296

[56] References Cited

U.S. PATENT DOCUMENTS

| | | | |
|---|---|---|---|
| 2,021,014 | 11/1935 | Moran | 405/226 X |
| 3,289,420 | 12/1966 | Guy | 405/226 |
| 3,289,421 | 12/1966 | Hindman | 405/228 |
| 3,314,240 | 4/1967 | Bardgette | 405/228 |
| 3,314,241 | 4/1967 | Mayhall | 405/228 |
| 4,318,641 | 3/1982 | Hogervorst | 405/228 X |
| 4,362,439 | 12/1982 | Vaynkof | 405/228 |
| 4,575,282 | 3/1986 | Pardue, Sr. et al. | 405/228 |
| 4,721,415 | 1/1988 | Shatto | 405/226 |
| 4,744,698 | 5/1988 | Dallimer et al. | 405/226 |
| 4,830,541 | 5/1989 | Shatto | 405/226 |
| 5,016,717 | 5/1991 | Simons et al. | 405/249 X |

OTHER PUBLICATIONS

Kraft Jr., L. M., "Performance of Axially Loaded Pipe Piles in Sand", Journal of Geotechnical Engineering, vol. 117, No. 2, Feb. 1991, pp. 272–296.

O'Neill M. W., et al., "Load Transfer for Pipe Piles in Highly Pressured Dense Sand", Journal of Geotechnical Engineering, vol. 117, No. 8, Aug. 1991, pp. 1208–1226.

Scott, C. R., *An Introduction to Soil Mechanics and Foundations,* Applied Science Publishers Ltd., London, 1980, pp. 79–81.

*Primary Examiner*—Tamara Graysay
*Assistant Examiner*—Tara L. Mayo
*Attorney, Agent, or Firm*—Rodney F. Brown

[57] ABSTRACT

A method is provided for installing a tubular member in a porous solid medium beneath the surface of a liquid body. The method is initiated by placing the member in a substantially upright position within the liquid body with an open end of the member positioned upon the solid medium and the opposite end of the member extending above the surface of the liquid body. A downward driving force is applied to the member in the direction of the solid medium, advancing the member into the solid medium. As the member is driven downward into the solid medium, a plug of the solid medium forms in the open interior of the member. The length of the plug corresponds to the depth that the member penetrates the solid medium. At the same time, liquids freely migrate into the open interior of the member from the liquid body or the solid medium respectively, via the open end of the member. A sufficient volume of migratory liquids, however, is withdrawn from the interior of the member to lower the level of migratory liquids in the interior substantially below the surface of the liquid body. As the level of migratory liquids in the interior drops below the surface of the liquid body, additional migratory liquids pass upwardly into the interior from the solid medium. The upward flow of migratory liquids within the plug causes a reduction in the effective stress in the plug, correspondingly causing a reduction in resistance from the plug to driving the member into the solid medium and facilitating installation of the member in the solid medium.

23 Claims, 1 Drawing Sheet

INSTALLATION OF A FOUNDATION PILE IN A SUBSURFACE SOIL

FIELD OF THE INVENTION

The present invention relates generally to the installation of an open-ended member in a solid medium and, more particularly, to a method for installing a tubular foundation pile or well conductor in a porous soil floor beneath the surface of a body of water.

BACKGROUND OF THE INVENTION

Offshore hydrocarbon production platforms are commonly fixed to the soil floor of a body of water by foundation piles and well conductors that extend from the floor to the platform. The piles and conductors are fabricated from open-ended steel pipes. The pipe is installed by driving an open end of the pipe into the soil floor down to a predetermined design penetration depth that is sufficient to firmly anchor the pipe in the floor. Installation typically employs an impact hammer to drive the pipe into the soil, applying repeated impacts with the hammer to the top of the pipe. The force of the impact must be sufficient to overcome the resistance of the soil to penetration by the pipe.

Installation problems often occur in dense unconsolidated cohesionless soils, such as sands or silts. The resistance of these types of soils to penetration by the pipe is extremely difficult to predict. Consequently, advance design of pipe installations in such soils has an inherently high degree of uncertainty. In many cases the pipe installer unexpectedly experiences "refusal" prior to reaching the predetermined design penetration depth in the soil when the number of impacts required to advance the pipe a given distance in the soil becomes impractically high. Refusal is generally attributable to the plug of soil that forms in the interior of the pipe as the open end advances through the soil. The plug has a relatively high resistance to penetration by the pipe. An accepted remediation technique upon experiencing refusal is to physically remove the soil plug from the pipe interior. Removal is accomplished by drilling the plug out from the pipe interior or jetting the plug out with high pressure steam or water. However, these are relatively costly and time consuming procedures that are advantageously avoided where possible. It is apparent that a need exists for alternate means of installing a pipe in a subsurface soil.

Accordingly, it is an object of the present invention to provide an effective method for installing a pipe in a subsurface soil by reducing the resistance of the soil to installation of the pipe therein. More particularly, it is an object of the present invention to provide a method for installing a foundation pile or well conductor associated with an offshore hydrocarbon production facility in a soil floor. It is another object of the present invention to provide such an installation method that does not require substantial modification to the conventional design of the piles or conductors being installed. It is still another object of the present invention to provide such an installation method that can be performed with conventional construction equipment. It is yet another object of the present invention to provide such an installation method that does not result in a diminished load-bearing capacity of the installed piles or conductors. It is a further object of the present invention to provide such an installation method that avoids the step of removing the plug from the interior of the pile or conductor. These objects and others are achieved in accordance with the invention described hereafter.

SUMMARY OF THE INVENTION

The present invention is a method for installing an open-ended elongated member in a porous solid medium beneath the surface of a liquid body. The member has an open first end, an open second end and a connective wall extending between the first and second ends. The first and second ends open into an interior chamber bounded by the connective wall such that both ends are in fluid communication with the interior chamber. The first end, interior chamber, and second end, in series, form a continuous open passageway through the member, enabling the deposit of foreign material into the interior chamber or the withdrawal of foreign material from the interior chamber via the first end or second end, respectively.

The present method is initiated by placing the member in a substantially upright position within the liquid body. The first end of the member is positioned at rest on the solid medium and the second end extends above the surface of the liquid body. A downward driving force is applied to the member in the direction of the solid medium, advancing the first end into the solid medium. As the first end is driven downward into the solid medium, a plug of the solid medium is formed in the interior chamber with the wall separating the plug from the remainder of the solid medium external to the interior chamber. The length of the plug corresponds substantially to the depth that the first end advances into the solid medium.

During placement of the member in the liquid body or displacement thereof into the solid medium, liquids freely pass by means of migration into the interior chamber from the liquid body or the solid medium, respectively, via the first end. In the absence of any intervention by the practitioner, the normal equilibrium level of migratory liquids within the interior chamber is approximately even with the surface of the liquid body. In accordance with the present invention, however, the practitioner intervenes with the equilibration of migratory liquids within the interior chamber by withdrawing a sufficient volume of migratory liquids from the interior chamber to lower the level of migratory liquids in the interior chamber substantially below the surface of the liquid body which is the equilibrium level. Withdrawal of migratory liquids from the interior chamber can be performed by pumping the migratory liquids out of the interior chamber via the second end and depositing the withdrawn liquids in the liquid body.

As the level of migratory liquids in the interior chamber drops below the surface of the liquid body, additional migratory liquids pass upwardly into the interior chamber from the solid medium via the first end of the member. The upward flow of migratory liquids within the plug causes a reduction in the effective stress in the plug, correspondingly causing a reduction in resistance from the plug to driving the first end into the solid medium. Consequently, installation of the member in the solid medium is facilitated.

The method of the present invention has specific utility to offshore hydrocarbon production applications. In accordance with such applications, the tubular elongated member is commonly a structure such as a tube or pipe that is installed in the soil on the floor of a body of water as a foundation pile or a well conductor for a hydrocarbon production facility, such as an offshore hydrocarbon production platform. The present method is particularly advantageous for offshore hydrocarbon production applications because it does not require substantial modification to the conventional design of piles or conductors, enabling conventional piles or conductors to be used in the practice of the method. The method can also be performed with conventional construction equipment, enabling the practitioner to readily incorporate the present method into common marine construction practices. In particular, the present method employs a conventional impact hammer to drive the pile or conductor into the soil. As a result, the method does not diminish the load-bearing capacity of the installed piles or conductors, which is generally a function of the installation procedure. Finally, the present method avoids the costly step of removing the plug from the interior of the pile or conductor required by many conventional installation methods.

The invention will be further understood from the accompanying drawings and description.

DETAILED DESCRIPTION OF PREFERRED EMBODIMENTS

The method of the present invention is described hereafter in terms of an offshore hydrocarbon production application for installing a tubular foundation pile, a well conductor, or the like in a soil on the floor of a body of water. It is understood, however, that the following description is generally applicable to the installation of substantially any open-ended member in a porous solid medium beneath the surface of a liquid body.

Figure 1:
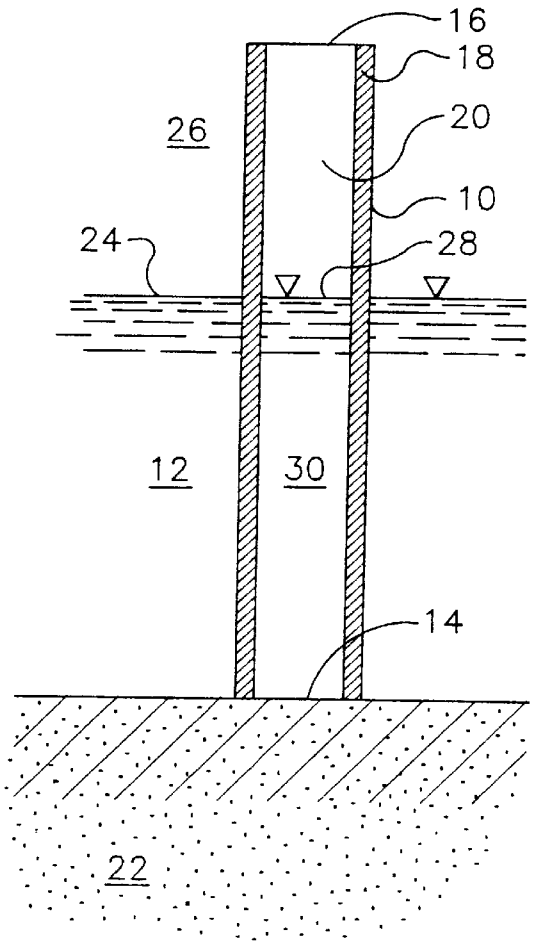
FIG. 1 is a schematic cross-sectional view of a tubular pile shown in its initial position top a soil underlying a body of water in accordance with the method of the present invention.

Referring at the outset to FIG. 1, a foundation pile 10 is shown initially positioned in a body of water 12. The pile 10 has a tubular construction including a first end 14, a second end 16 and a connective wall 18 extending between the first end 14 and the second end 16. The pile 10 is hollow, having an interior chamber 20 bounded by the connective wall 18. The first end 14 and the second end 16 are both open and in fluid communication with the interior chamber 20. As such, the first end 14, interior chamber 20, and second end 16 define a continuous passageway 14, 20, 16 through the pile 10 that maintains the interior chamber 20 open to the external environment surrounding the pile 10. The pile 10 is constructed from materials well known to the skilled artisan and is designed with sufficient strength to resist buckling due to downward driving forces applied to the pile 10 during installation and hydrostatic pressures experienced by the pile 10 when liquids are withdrawn from the interior chamber 20 in a manner described hereafter.

The pile 10 is initially positioned substantially upright in the body of water 12 with the first end 14 resting on a soil 22 forming the floor beneath the surface 24 of the body of water 12. The soil 22 is a porous solid material that is typically unconsolidated, such as sand or silt, although the soil 22 may be relatively densely packed. The second end 16 of the pile 10 extends above the water surface 24 and is open to the atmosphere 26. During initial positioning of the pile 10, liquids from the body of water 12 freely migrate into the interior chamber 20 via the open first end 14 of the pile 10. Consequently, the water surface 24 external to the pile 10 is substantially even and equilibrated with the level 28 of migratory liquids 30 internal to the pile 10 within the interior chamber 20.

Upon positioning of the pile 10, the weight of the pile 10 typically advances the first end 14 of the pile 10 into the soil 22 to an initial penetration depth. Thereafter, a downward driving force is applied to the pile 10, advancing the first end 14 of the pile 10 into the soil 22 a depth sufficient to cut off direct fluid communication between the first end 14 and the body of water 12, although indirect fluid communication between the first end 14 and the body of water 12 via the soil 22 may remain. The downward driving force is preferably applied to the pile 10 by conventional means such as by sequentially striking the second end 16 of the pile 10 with an impact hammer (not shown).

Figure 2:
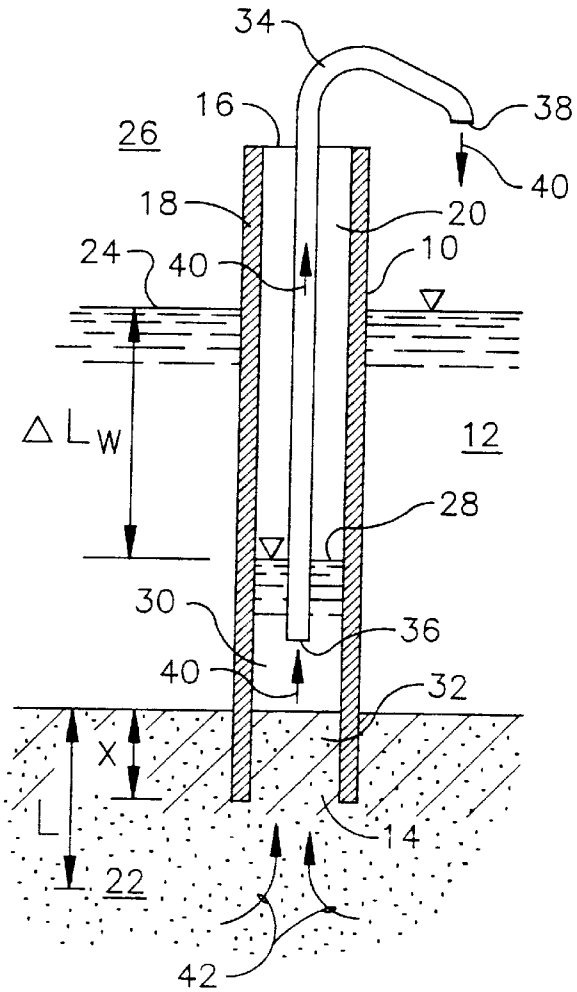
FIG. 2 is a schematic cross-sectional view of the pile of FIG. 1 shown partially driven into the soil in accordance with the method of the present invention.

Referring to FIG. 2, the first end 14 of the pile 10 is shown having been displaced a sufficient depth into the soil 22 by the driving force to cut off direct fluid communication between the first end 14 and the body of water 12. Displacement of the first end 14 into the soil 22 on the subsurface floor creates a plug 32 of soil extending upward within the interior chamber 20 from the first end 14 to approximately the level of the soil 22 forming the subsurface floor external to the pile 10. The plug 32 and soil 22 restrict direct fluid communication between the first end 14 and the body of water 12.

A migratory liquids discharge line 34 having an inlet port 36 and an outlet port 38 is positioned relative to the pile 10 such that the inlet port 36 is submerged within the interior chamber 20 below the migratory liquids level 28. The migratory liquids discharge line 34 extends from the interior chamber 20 through the second end 16 where the outlet port 38 opens to the external environment. A pump (not shown) is connected to the migratory liquids discharge line 34 enabling withdrawal of the migratory liquids 30 from the interior chamber 20 through the inlet port 36 and discharge of these migratory liquids into the external environment, such as the body of water 12, via the discharge line 34 and outlet port 38 in accordance with the directional arrows 40. Specification and placement of a pump having utility herein is readily within the purview of the skilled artisan. It is further apparent that the configuration of the migratory liquids discharge line 34 is shown conceptually in FIG. 2 and that the configuration of the migratory liquids discharge line 34 is readily adaptable by the skilled artisan to accommodate unencumbered operation of the impact hammer or other conventional driving means.

By controlling the pumping rate, and correspondingly the migratory liquids withdrawal rate from the interior chamber 20, the practitioner is able to draw down the migratory liquids level 28 within the interior chamber 20 to a level below the water surface 24, which is the normal equilibrium level of the migratory liquids 30. It has been found that lowering the migratory liquids level 28 below the water surface 24 reduces the amount of driving force required to advance the pile 10 in the soil 22 a given distance or, conversely, increases the distance the pile 10 advances in the soil 22 for a given driving force. Furthermore, it has been found that, within limits, the distance of the drawdown directly correlates to the degree of force reduction or distance increase achieved.

Although the method of the present invention is not limited to a particular mechanism, it is believed that the plug 32 is a primary resistant to the downwardly directed driving force applied to the pile 10. Thus, the pile 10 can be advantageously advanced to a greater depth in the soil 22 for a given driving force by reducing the resistance of the plug 32 to the driving force. Alternatively, by reducing the resistance of the plug 32 to the driving force, the force required to advance the pile 10 a given distance in the soil 22 can be reduced. Since the resistance of the plug 32 to the driving force is proportional to the effective stress in the soil of the plug 32, the resistance of the plug 32 to the driving force is reduced by attendantly reducing the effective stress in the plug 32. When the migratory liquids level 28 in the interior chamber 20 is drawn down, the hydrostatic pressure of the migratory liquids 30 in the interior chamber 20 against the plug 32 is decreased. As a result, additional migratory liquids flow upwardly from the soil 22 through the first end 14 and plug 32, as denoted by the directional arrows 42, into the interior chamber 20. The upward flow gradient within the plug 32 created by the flow of migratory liquids therethrough reduces the effective stress in the plug 32 and correspondingly reduces the resistance of the plug 32 to the driving force.

The above-described relationships can be characterized mathematically in accordance with the equations set forth below, wherein the variables are defined as follows:

D=outside diameter of pile wt=wall thickness of pile

L=target depth of pile in soil $\phi$=friction angle of the soil $\kappa$=lateral pressure coefficient of soil $\gamma$=unit weight of soil saturated in air $\gamma_w$=unit weight of liquid x=depth in soil $\sigma_x$=effective horizontal stress of plug at depth x $\sigma_z$=effective vertical stress of plug at depth x $\underline{P}$=total resistance of plug to driving force $\Delta L_w$=migratory liquids level reduction below water surface $\Delta\sigma_z$=effective vertical stress reduction in plug due to liquids level reduction $$\sigma_z=(Y-Y_w)x \quad (1)$$

$$\sigma_x=K\sigma_z \tan\phi \quad (2)$$

$$\sigma_x=K(Y-Y_w)x \tan\phi \quad (3)$$

$$(4)\ \underline{P}=\pi(D-2wt)\int_0^L \sigma_x\,dx$$

$$(5)\ \underline{P}=\pi(D-2wf)\int_0^L K(Y-Y_w)\times\tan\phi\,dx$$

$$\Delta\sigma_z=Y_w\Delta L_w \quad (6)$$

with the limitation that $\Delta\sigma_z \leqq \sigma_z$.

At the bottom end of the pile, if $\Delta\sigma_{z(x=L)}=\sigma_{z(x=L)}$, the effective stress in the entire soil plug is zero and the resistance due to the soil plug is correspondingly zero.

$$(7)\ \Delta L_w=\frac{(Y-Y_w)}{Y_w}L$$

Figure 3:
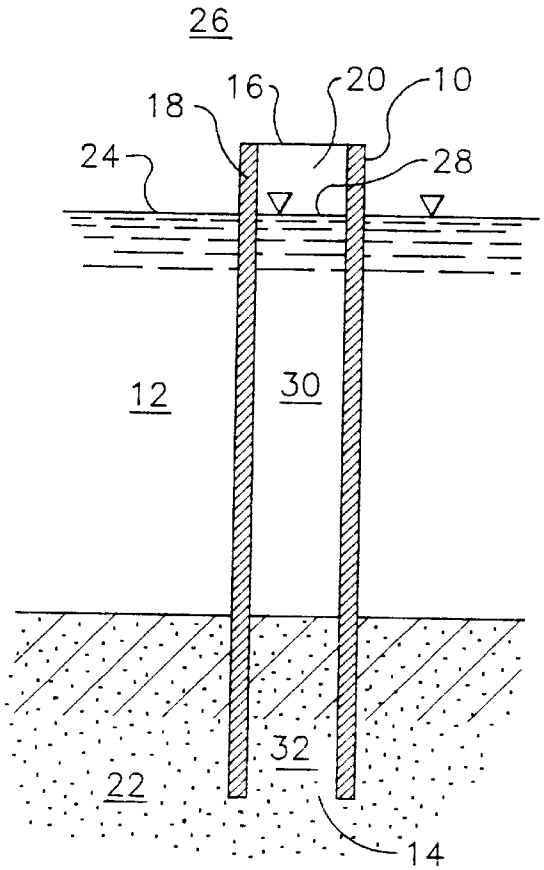
FIG. 3 is a schematic cross-sectional view of the pile of FIG. 1 shown fully driven into the soil in accordance with the method of the present invention.

It is noted that to maintain the migratory liquids level 28 below the water surface 24, the additional migratory liquids must be withdrawn from the interior chamber 20 via the migratory liquids discharge line 34 at the same rate or a greater rate than the additional migratory liquids enter the interior chamber 20 depending on the migratory liquids level 28 desired in the interior chamber 20. In a preferred embodiment of the present method, a desired migratory liquids level is predetermined by the practitioner. The migratory liquids level 28 is then drawn down from the normal equilibrium level of FIG. 1 to the desired level of FIG. 2, by selecting the appropriate pumping conditions in a manner within the purview of the skilled artisan. Once the desired migratory liquids level 28 is reached, the pumping conditions are adjusted to achieve steady-state flow of migratory liquids 30 through the interior chamber 20, thereby maintaining the desired migratory liquids level 28 within the interior chamber 20 as shown in FIG. 2. When the first end 14 of the pile 10 advances to the final desired depth within the soil 22, application of the driving force to the pile 10 is terminated and withdrawal of additional migratory liquids 30 from the interior chamber 20 is likewise terminated. The migratory liquids level 28 in the interior chamber 20 then returns to its normal equilibrium level substantially even with the water surface 24 and the pile 10 is suitably installed in the soil 22 for its intended purpose as shown in FIG. 3.

The following example demonstrates the practice and utility of the present invention, but is not to be construed as limiting the scope thereof.

Example

A tubular pile is to be installed in a subsurface soil using the method of the present invention so that upon completion of installation, the pile penetrates the soil to a depth of 100 feet (L=100'). The pile has a wall thickness of 1 inch (wt=1") and an outside diameter of 30 inches (D=30"). The remaining independent variables are determined to be as follows:

$\Phi$=30°

$\kappa$=0.8

$\gamma$=125 PCF $\gamma_w$=64 PCF

Applying equation (5), the total resistance of the plug to the driving force is calculated to be 1,032,657 pounds when the liquids level in the pile is even with the water surface. It is desired to reduce the total resistance of the plug to zero employing the method of the present invention. The total resistance of the plug goes to zero when the effective stress in the entire soil plug is zero ($\Delta\sigma_{z(100)}=\sigma_{z(100)}$). Applying equation (7), the resistance of the plug is reduced to zero by reducing the liquids level in the pile by 95.3 feet below the water surface in accordance with the present method.

While the foregoing preferred embodiments of the invention have been described and shown, it is understood that alternatives and modifications, such as those suggested and others, may be made thereto and fall within the scope of the present invention.

I claim:

1. A method for installing an open-ended member in a solid medium beneath the surface of a liquid body comprising:

providing said member having a first end, a second end, and an interior chamber, wherein said first end is open and said interior chamber is in fluid communication with said first end;

positioning said member on said solid medium;

passing a migratory liquid through said first end into said interior chamber;

withdrawing a sufficient volume of said migratory liquid from a portion of said interior chamber to position the level of said migratory liquid in said interior chamber below said surface of said liquid body while maintain ing said portion of said interior chamber substantially at atmospheric pressure; and driving said member into said solid medium.

2. The method of claim 1 further comprising passing a portion of said solid medium through said first end to form a plug of said solid medium in said interior chamber.

3. The method of claim 2 further comprising passing an additional volume of said migratory liquid through said first end and said plug into said interior chamber while withdrawing said sufficient volume of said migratory liquid from said portion of said interior chamber.

4. The method of claim 3 wherein passing said additional volume of said migratory liquid through said first end and said plug substantially reduces the effective stress of said plug.

5. The method of claim 3 wherein passing said additional volume of said migratory liquid through first end and said plug substantially reduces the resistance of said plug to driving said member into said solid medium.

6. The method of claim 3 wherein said sufficient volume of said migratory liquid is continuously withdrawn from said interior chamber and said additional volume of said migratory liquid is continuously passed through said first end and said plug into said interior chamber to maintain the level of said migratory liquid in said interior chamber below said surface of said liquid body until said member is driven to a desired depth in said solid medium.

7. The method of claim I wherein said member is driven into said solid medium by applying a driving force to said member in the direction of said solid medium.

8. The method of claim 1 wherein said first end is driven into said solid medium by striking said second end with an impact hammer.

9. The method of claim 1 wherein said second end is open and in fluid communication with said interior chamber.

10. The method of claim 1 wherein said member is a pipe and said first end, said interior chamber and said second end form a continuous open passageway.

11. The method of claim 1 wherein said solid medium is a porous material.

12. The method of claim 1 wherein said solid medium is a soil.

13. The method of claim 1 wherein said sufficient volume of said migratory liquid is withdrawn from said interior chamber by pumping.

14. The method of claim 1 further comprising discharging said sufficient volume of said migratory liquid withdrawn from said interior chamber to said liquid body.

15. The method of claim 1 wherein said member is a foundation pile or a well conductor for a hydrocarbon production facility.

16. A method for installing an open-ended member in a solid medium beneath the surface of a liquid body comprising:

providing said member having a first end, a second end, and an interior chamber, wherein said first end is open and said interior chamber is in fluid communication with said first end;

positioning said first end on said solid medium;

passing a migratory liquid through said first end into said interior chamber;

passing a portion of said solid medium through said first end to form a plug of said solid medium in said interior chamber;

withdrawing a sufficient volume of said migratory liquid from a portion of said interior chamber to position the level of said migratory liquid in said interior chamber below said surface of said liquid body and above the level of said plug while maintaining said portion of said interior chamber substantially at atmospheric pressure;

passing an additional volume of said migratory liquid through said first end and said plug into said interior chamber while withdrawing said sufficient volume of said migratory liquid from said first portion of said interior chamber; and driving said first end into said solid medium.

17. The method of claim 16 wherein passing said additional volume of said migratory liquid through said first end and said plug substantially reduces the effective stress of said plug.

18. The method of claim 16 wherein passing said additional volume of said migratory liquid through first end and said plug substantially reduces the resistance of said plug to driving said first end into said solid medium.

19. The method of claim 16 wherein said sufficient volume of said migratory liquid is continuously withdrawn from said interior chamber and said additional volume of said migratory liquid is continuously passed through said first end and said plug into said interior chamber to maintain the level of said migratory liquid in said interior chamber below said surface of said liquid body until said first end is driven to a desired depth in said solid medium.

20. A method for installing a tubular member in a porous soil on a floor of a body of water comprising:

providing said tubular member having a first open end, a second open end, and an interior chamber, wherein said first open end, interior chamber and second open end define a continuous open passageway;

positioning said first open end on said soil;

passing water through said first open end into said interior chamber;

passing a portion of said soil through said first open end to form a plug of said soil in said interior chamber;

pumping a sufficient volume of water from said interior chamber to position the level of water in said interior chamber below said surface of said body of water and above the level of said plug;

passing additional water through said first open end and said plug into said interior chamber while withdrawing said sufficient volume of water from said interior chamber; and driving said first open end into said soil.

21. The method of claim 20 wherein passing said additional water through said first open end and said plug substantially reduces the effective stress of said plug.

22. The method of claim 20 wherein passing said additional water through first open end and said plug substantially reduces the resistance of said plug to driving said first open end into said soil.

23. The method of claim 20 wherein said sufficient volume of water is continuously pumped from said interior chamber and said additional water is continuously passed through said first end and said plug into said interior chamber to maintain the level of water in said interior chamber below said surface of said body of water until said first open end is driven to a desired depth in said soil.

* * * * *